US011150566B2

(12) United States Patent
Iwasaki et al.

(10) Patent No.: US 11,150,566 B2
(45) Date of Patent: Oct. 19, 2021

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Shuhei Iwasaki, Yokohama (JP); Akira Sakakibara, Susono (JP); Jumpei Kuno, Yokohama (JP); Yota Ito, Mishima (JP); Kohei Makisumi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/891,525

(22) Filed: Jun. 3, 2020

(65) Prior Publication Data

US 2020/0393771 A1 Dec. 17, 2020

(30) Foreign Application Priority Data

Jun. 14, 2019 (JP) ..... JP2019-111486

(51) Int. Cl.
*G03G 5/00* (2006.01)
*G03G 5/043* (2006.01)
(Continued)

(52) U.S. Cl.
CPC ..... *G03G 5/043* (2013.01); *G03G 5/0696* (2013.01); *G03G 5/102* (2013.01); *G03G 5/104* (2013.01); *G03G 5/144* (2013.01); *G03G 15/162* (2013.01)

(58) Field of Classification Search
CPC ..... G03G 5/043; G03G 5/104; G03G 5/102; G03G 5/144; G03G 15/162
(Continued)

(56) References Cited

U.S. PATENT DOCUMENTS 9,029,054 B2 5/2015 Okuda et al.
9,069,267 B2 5/2015 Kaku et al.
(Continued)

FOREIGN PATENT DOCUMENTS

JP 2002-287396 10/2002
JP 2002-372796 12/2002
(Continued)

OTHER PUBLICATIONS

U.S. Appl. No. 16/903,525, Kohei Makisumi, filed Jun. 17, 2020.
(Continued)

*Primary Examiner* — Mark A Chapman
(74) *Attorney, Agent, or Firm* — Venable LLP

(57) ABSTRACT

The present disclosure provides an electrophotographic photosensitive member that can simultaneously achieve the suppression of the occurrence of the black spot in a charged portion and the suppression of the deterioration in sensitivity of an exposed portion, even after stored in a high-temperature and high-humidity environment. An electrophotographic photosensitive member includes an electro-conductive support, an undercoat layer, a charge generation layer and a charge transport layer in this order, wherein an atomic concentration ratio R of the oxygen atom to the aluminum atom on the surface of the electro-conductive support, as measured by energy dispersive X-ray spectroscopy, satisfies the following Expression (1):

$$1.6 \leq R \quad (1)$$

and the undercoat layer includes a titanium oxide particle that is surface-treated with a particular silane compound.

10 Claims, 2 Drawing Sheets

(51) Int. Cl.

| | |
|---|---|
| ***G03G 5/06*** | (2006.01) |
| ***G03G 5/10*** | (2006.01) |
| ***G03G 5/14*** | (2006.01) |
| ***G03G 15/16*** | (2006.01) |

(58) Field of Classification Search
USPC ..... 430/69, 60
See application file for complete search history.

(56) References Cited

U.S. PATENT DOCUMENTS

| | | | |
|---|---|---|---|
| 9,063,505 | B2 | 6/2015 | Sekiya et al. |
| 9,523,929 | B2 | 12/2016 | Nakamura et al. |
| 9,535,346 | B2 | 1/2017 | Sekiya et al. |
| 9,563,139 | B2 | 2/2017 | Kawahara et al. |
| 9,645,516 | B2 | 5/2017 | Kawahara et al. |
| 9,772,569 | B2 | 9/2017 | Tanaka et al. |
| 9,851,646 | B2 | 12/2017 | Tomono et al. |
| 9,869,032 | B2 | 1/2018 | Kawahara et al. |
| 10,152,002 | B2 | 12/2018 | Anezaki et al. |
| 10,162,278 | B2 | 12/2018 | Kuno et al. |
| 10,203,617 | B2 | 2/2019 | Kuno et al. |
| 10,303,085 | B2 | 5/2019 | Sato et al. |
| 10,416,581 | B2 | 9/2019 | Ito et al. |
| 10,452,021 | B2 | 10/2019 | Miura et al. |
| 10,545,453 | B2 | 1/2020 | Iwasaki et al. |
| 10,663,913 | B2 | 5/2020 | Yamaai et al. |
| 2004/0265715 | A1 | 12/2004 | Itami et al. |
| 2009/0232552 | A1 | 9/2009 | Mitsumori et al. |
| 2015/0185630 | A1 | 7/2015 | Ito et al. |
| 2015/0185634 | A1 | 7/2015 | Sekiya et al. |
| 2015/0277246 | A1 | 10/2015 | Kaku et al. |
| 2015/0277247 | A1 | 10/2015 | Sekiya et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2020/0159137 | A1 | 5/2020 | Ito et al. |
| 2020/0174385 | A1 | 6/2020 | Sakakibara et al. |

FOREIGN PATENT DOCUMENTS

| | | |
|---|---|---|
| JP | 2003-215825 | 7/2003 |
| JP | 2004-101799 | 4/2004 |
| JP | 2005-309116 | 11/2005 |
| JP | 2009-104125 | 5/2009 |
| JP | 2016-118783 | 6/2016 |
| JP | 2018-141974 | 9/2018 |
| JP | 2019-060928 | 4/2019 |

OTHER PUBLICATIONS

U.S. Appl. No. 16/904,700, Michiyo Sekiya, filed Jun. 18, 2020.
U.S. Appl. No. 16/904,705, Tomohito Ishida, filed Jun. 18, 2020.
U.S. Appl. No. 16/905,427, Kaname Watariguchi, filed Jun. 18, 2020.
U.S. Appl. No. 17/065,258, Kohei Makisumi, filed Oct. 7, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus including the electrophotographic photosensitive member.

Description of the Related Art

In the electrophotographic process, in recent years, it has been required to further enhance an image quality of printed images. In order to satisfy this requirement, such a method has been studied as to improve the sharpness of the printed images by enhancing a potential contrast between a charging potential formed on an electrophotographic photosensitive member and an exposure potential.

When the potential contrast is set high by the above method, there has been a case where a high electric field acts on the charged portion of the electrophotographic photosensitive member to inject an electric charge thereto from an electro-conductive support of the electrophotographic photosensitive member. When such charge injection occurs, there has been a problem that such a phenomenon occurs that a toner adheres to a region in which an image should be formed originally as a white portion, in other words, a black spot occurs due to local defect of a charging potential.

In order to suppress the occurrence of the black spot, in Japanese Patent Application Laid-Open No. 2005-309116 and Japanese Patent Application Laid-Open No. 2002-287396, a photosensitive member is proposed that has an undercoat layer containing a metal oxide between an electro-conductive support and a charge generation layer.

According to studies by the present inventors, it has been found that the electrophotographic photosensitive member described in Japanese Patent Application Laid-Open No. 2005-309116 or Japanese Patent Application Laid-Open No. 2002-287396 can suppress the occurrence of the black spot, but on the other hand, after stored in a high-temperature and high-humidity environment, the exposure potential rises, a desired potential contrast is not obtained, and the density of the black portion decreases. In recent years, it has been desired that a stable image is outputted even after exposed to the high-temperature and high-humidity environment in storage, transportation and the like.

Accordingly, the object of the present disclosure is to provide an electrophotographic photosensitive member that can simultaneously achieve the suppression of the occurrence of the black spot in a charged portion and the suppression of the deterioration in sensitivity of an exposed portion, even after stored in a high-temperature and high-humidity environment.

SUMMARY OF THE INVENTION

The above object is achieved by the following present disclosure.

Specifically, the electrophotographic photosensitive member according to the present disclosure is an electrophotographic photosensitive member that has an electro-conductive support, an undercoat layer, a charge generation layer and a charge transport layer in this order, wherein an atomic concentration ratio R of the oxygen atom to the aluminum atom on the surface of the electro-conductive support, as measured by energy dispersive X-ray spectroscopy, satisfies the following Expression (1):

$$1.6 \leq R \quad (1)$$

and the undercoat layer includes a titanium oxide particle that is surface-treated with at least one chemical compound represented by the following Formulae (A-1) to (A-10).

In the following Formulae (A-1) to (A-10), $R^1$ to $R^{10}$ represent a methyl group, an ethyl group or an acetyl group; $X^1$ to $X^5$ represent a hydrogen atom or a methyl group; and n is 1 to 7.

(A-1)

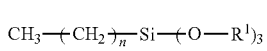

(A-2)

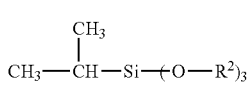

(A-3)

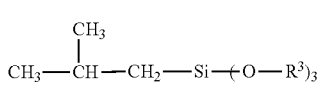

(A-4)

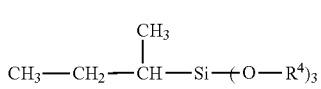

(A-5)

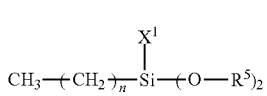

(A-6)

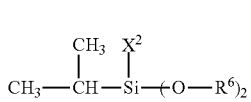

(A-7)

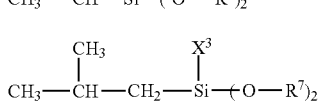

(A-8)

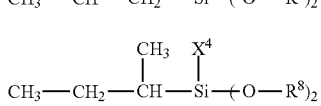

(A-9)

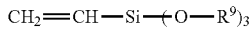

(A-10)

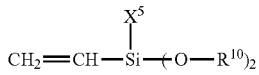

Further features of the present disclosure will become apparent from the following description of exemplary embodiments with reference to the attached drawings.

DESCRIPTION OF THE EMBODIMENTS

Figure 1:
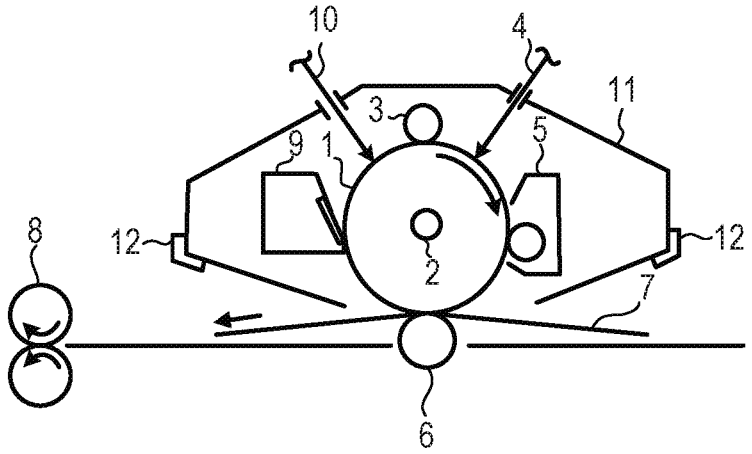
FIG. 1 is a view illustrating one example of a schematic configuration of an electrophotographic apparatus provided with a process cartridge including an electrophotographic photosensitive member of the present disclosure.

Preferred embodiments of the present disclosure will now be described in detail in accordance with the accompanying drawings.

The present inventors have made studies, and as a result, have found out that when the surface of the electro-conductive support constituting the electrophotographic photosensitive member has a particular elemental composition, and an organic functional group on the surface of the titanium oxide particle contained in the undercoat layer has a particular structure, the electrophotographic photosensitive member can simultaneously suppress the occurrence of the black spot in the charged portion and the deterioration in sensitivity of the exposed portion, even after stored in a high-temperature and high-humidity environment.

Specifically, the electrophotographic photosensitive member includes an electro-conductive support, an undercoat layer, a charge generation layer and a charge transport layer in this order, wherein the atomic concentration ratio R of the oxygen atom to the aluminum atom on the surface of the electro-conductive support, as measured by energy dispersive X-ray spectroscopy, satisfies the following Expression (1):

$$1.6 \leq R \quad (1)$$

and the undercoat layer includes a titanium oxide particle that is surface-treated with at least one chemical compound represented by the following Formulae (A-1) to (A-10).

In the following Formulae (A-1) to (A-10), $R^1$ to $R^{10}$ represent a methyl group, an ethyl group or an acetyl group; $X^1$ to $X^5$ represent a hydrogen atom or a methyl group; and n is 1 to 7.

(A-1)

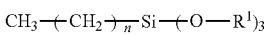

(A-2)

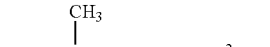

(A-3)

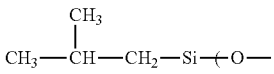

(A-4)

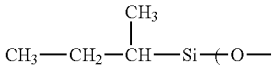

(A-5)

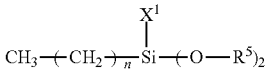

(A-6)

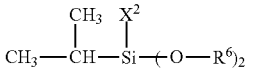

(A-7)

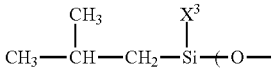

(A-8)

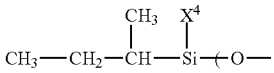

(A-9)

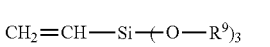

(A-10)

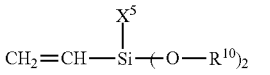

The detailed mechanism of the effect exerted by the present disclosure is unknown, but the mechanism is assumed to be the following. It has been revealed that in the prior art, the electrophotographic photosensitive member is constructed so as to have an undercoat layer containing a metal oxide between an electro-conductive support and a charge generation layer and so that the metal oxide is surface-treated, thereby can suppress the occurrence of the black spot due to local charge injection, but that on the other hand, the exposure potential rises after the member is stored in a high-temperature and high-humidity environment. The reason is considered to be that charge transfer at the interface between the electro-conductive support and the undercoat layer is obstructed by the adsorption of moisture.

In order to solve the above technical problem, the present inventors have made studies, and as a result, have found out that when the surface of the electro-conductive support constituting the electrophotographic photosensitive member has a particular composition, and the surface of the titanium oxide particle contained in the undercoat layer is surface-treated with a chemical compound having a particular structure, the electrophotographic photosensitive member can simultaneously suppress the occurrence of the black spot in the charged portion and the deterioration in sensitivity of the exposed portion, even after stored in the high-temperature and high-humidity environment. The reason is assumed to be that the charge interchange characteristics at the interface between the electro-conductive support and the undercoat layer are stabilized, and the obstruction of charge transfer due to the adsorption of moisture is suppressed. It has been revealed that in order to suppress the obstruction of charge transfer, it is important to simultaneously control an atomic concentration ratio of a particular element on the surface of the electro-conductive support, the type of metal oxide contained in the undercoat layer, and the structure of the surface treatment compound.

Specifically, the electrophotographic photosensitive member includes an electro-conductive support, an undercoat layer, a charge generation layer and a charge transport layer in this order, wherein the atomic concentration ratio R of the oxygen atom to the aluminum atom on the surface of the electro-conductive support, as measured by energy dispersive X-ray spectroscopy, satisfies the following Expression (1):

$$1.6 \leq R \quad (1)$$

and the undercoat layer includes a titanium oxide particle that is surface-treated with at least one chemical compound represented by the following Formulae (A-1) to (A-10).

In the following Formulae (A-1) to (A-10), $R^1$ to $R^{10}$ represent a methyl group, an ethyl group or an acetyl group; $X^1$ to $X^5$ represent a hydrogen atom or a methyl group; and n is 1 to 7.

(A-1)

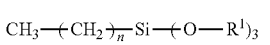

(A-2)

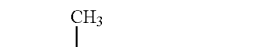

(A-3)

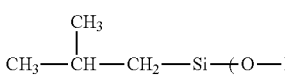

(A-4)

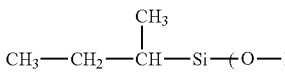

-continued (A-5)

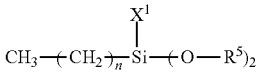

(A-6)

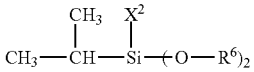

(A-7)

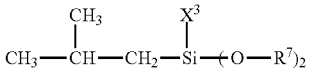

(A-8)

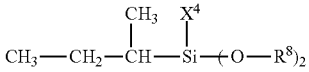

(A-9)

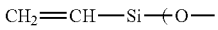

(A-10)

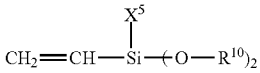

In the electro-conductive support according to the present disclosure, it is preferable that the length L of the region satisfying the Expression (1) is 1 μm or more and 10 μm or less from the surface of the electro-conductive support, in that the charge interchange characteristics at the interface between the electro-conductive support and the undercoat layer are stabilized, and the obstruction of the charge transfer due to the adsorption of moisture is suppressed.

Furthermore, in the electro-conductive support according to the present disclosure, it is preferable that arithmetic average roughness Sa of the surface is 3 μm or less, in terms of enhancing the adhesion between the electro-conductive support and the undercoat layer, and further stabilizing the charge interchange characteristics at the interface.

In addition, it is preferable that the undercoat layer according to the present disclosure contains a polyamide resin, in terms of enhancing the adhesion between the electro-conductive support and the undercoat layer, and further stabilizing the charge interchange characteristics at the interface.

In addition, a second embodiment according to the present disclosure is an electrophotographic photosensitive member that includes an electro-conductive support, an undercoat layer, a charge generation layer and a charge transport layer in this order, wherein an atomic concentration ratio R of the oxygen atom to the aluminum atom on the surface of the electro-conductive support, as measured by energy dispersive X-ray spectroscopy, satisfies the following Expression (1):

$$1.6 \leq R \quad (1)$$

and the undercoat layer includes a titanium oxide particle, and the titanium oxide particle has at least one organic functional group represented by the following Formulae (B-1) to (B-10), on the surface.

In the following Formulae (B-1) to (B-10), $R^{11}$ to $R^{20}$ represent a methyl group, an ethyl group or an acetyl group; $X^6$ to $X^{10}$ represent a hydrogen atom or a methyl group; x is an integer of 1 to 7; y is an integer of 1 to 3; z is an integer of 1 to 2; and the organic functional group is bonded to the surface of the titanium oxide particle at *.

(B-1)

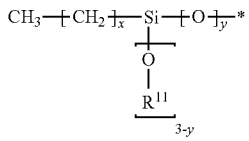

(B-2)

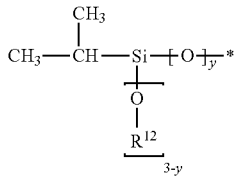

(B-3)

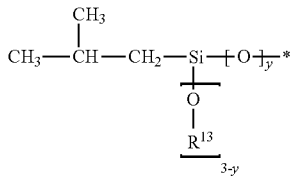

(B-4)

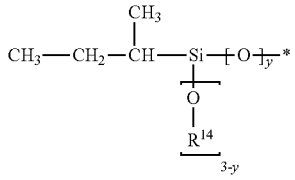

(B-5)

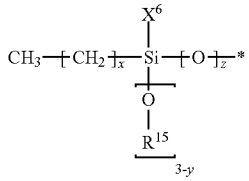

(B-6)

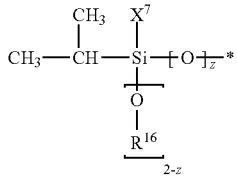

(B-7)

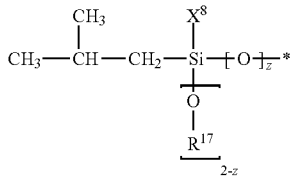

(B-8)

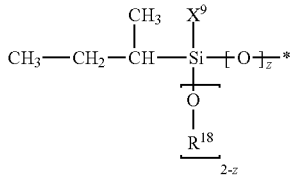

-continued (B-9)

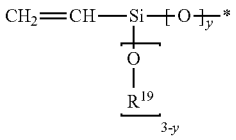

(B-10)

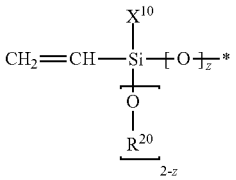

For example, in Formula (B-1), when y is 3, the organic functional group of Formula (B-1) has three bonds to the surface of the titanium oxide particle.

[Atomic Concentration Ratio R on Surface of Electro-Conductive Support]

The atomic concentration ratio R of the oxygen atom to the aluminum atom on the surface of the electro-conductive support can be measured with a scanning electron microscope (JSM-7800, manufactured by JEOL Ltd.) and an energy dispersive X-ray analyzer (manufactured by Thermo Fisher Scientific K.K.) in combination.

Setting the electron microscope at a magnification of 3000 times and an acceleration voltage of 5 kV, and irradiating the surface with electron beam for observation, the atomic concentration ratio R of the oxygen atom to the aluminum atom is given by the expression:

$$R=[rO/rAL]\times 100$$

where the atomic concentration of oxygen is represented by rO and the atomic concentration of aluminum is represented by rAL.

The above method for measuring the atomic concentration ratio R of the oxygen atom to the aluminum atom will be denoted as "Evaluation 1" in the Examples.

[Length L of Region Satisfying Expression (1) of Electro-Conductive Support]

The length L of the region on the surface of the electro-conductive support, which satisfies the Expression (1), can be measured with an eddy-current film thickness tester (Fischerscope, manufactured by Fisher Instruments K.K.). The method for measuring the above length L of the region on the surface of the electro-conductive support, which satisfies the Expression (1), will be denoted as "Evaluation 2" in the Examples.

[Arithmetic Average Roughness Sa of Surface of Electro-Conductive Support]

The arithmetic average roughness Sa of the surface of the electro-conductive support can be measured with a confocal laser microscope (manufactured by Lasertec Corporation). A range of 1000 μm×1000 μM is measured with an objective lens having a magnification of 10 times, and the arithmetic average roughness Sa is obtained. When the measurement object is cylindrical, the curvature correction in the XY direction is performed. Note that in the present specification, the arithmetic average roughness Sa shows a parameter indicating a three-dimensional surface property based on ISO 25178. The above method of measuring the arithmetic average roughness Sa of the surface of the electro-conductive support will be denoted as "Evaluation 3" in the Examples.

[Electrophotographic Photosensitive Member]

The electrophotographic photosensitive member of the present disclosure includes: an electro-conductive support; an undercoat layer that is formed directly on the support; a charge generation layer that is formed on the undercoat layer; and a charge transport layer that is formed on the charge generation layer. As will be shown below, the expression "formed on" not only means that an upper layer is formed in direct contact with a lower layer, but also includes the case where the upper layer is formed on some other formed layer. On the other hand, the expression "formed directly on" means that an upper layer is formed in direct contact with a lower layer.

Figure 2:
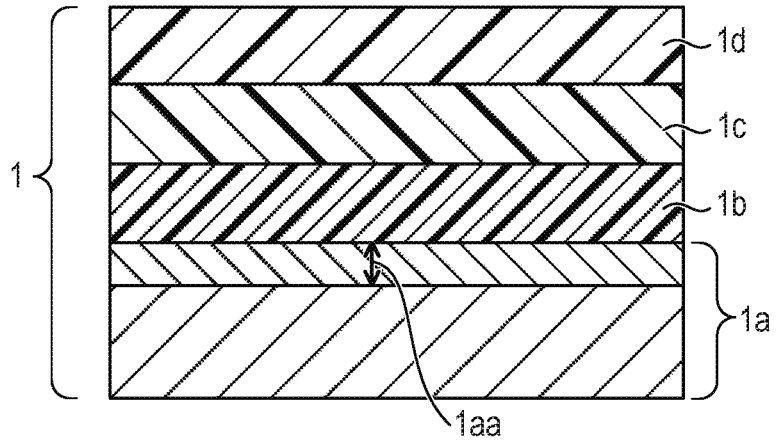
FIG. 2 shows a view illustrating one example of a schematic configuration of the electrophotographic photosensitive member of the present disclosure.

FIG. 2 illustrates one example of a schematic configuration of the electrophotographic photosensitive member 1. The electro-conductive support 1*a* is illustrated, and the length (L) 1*aa* of the region on the surface of the electro-conductive support, which satisfies the Expression (1), is illustrated. An undercoat layer 1*b* is illustrated, a charge generation layer 1*c* is illustrated, and a charge transport layer 1*d* is illustrated.

A method for manufacturing the electrophotographic photosensitive member includes a method of: preparing coating liquids for the respective layers, which will be described later; applying the coating liquids in the desired order of the layers, respectively; and drying the coating liquids. At this time, a coating method of the coating liquid includes a dip coating method, a spray coating method, a curtain coating method and a spin coating method. Among the methods, the dip coating method is preferable from the viewpoints of efficiency and productivity.

The electro-conductive support and each layer will be described below.

<Electro-Conductive Support>

In the present disclosure, the electrophotographic photosensitive member has an electro-conductive support made from aluminum or an aluminum alloy. Shapes of the support include a cylindrical shape, a belt shape and a sheet shape. Among the supports, the cylindrical support is preferable.

In the present disclosure, in the electro-conductive support made from aluminum or an aluminum alloy, the atomic concentration ratio R of the oxygen atom to the aluminum atom on the surface, as measured by energy dispersive X-ray spectroscopy, satisfies the following Expression (1):

$$1.6\leq R \quad (1).$$

The surface of the electro-conductive support made from aluminum or an aluminum alloy, which satisfies the Expression (1), is not limited in particular, but is preferably a surface formed by anodization of aluminum in an acidic liquid containing an oxidizing agent.

Here, in preparation of the anodized surface used for the electrophotographic photosensitive member of the present disclosure, for example, an inorganic acid such as sulfuric acid or chromic acid, or an organic acid such as oxalic acid or sulfonic acid can be used as an electrolytic solution. Conditions such as a voltage to be applied, a current density, and a temperature and a time period of the treatment can be selected according to the type of the above electrolyte, and to the film thickness. In addition, in preparation of the anodized surface used for the electrophotographic photosensitive member of the present disclosure, the untreated surface may be subjected to the electrolytic treatment followed by sealing treatment. As a method of the sealing treatment, hot water treatment, steam treatment or any of various sealing agents such as nickel acetate and nickel fluoride may be used, but it is preferable to treat the surface with nickel acetate which can efficiently seal fine holes.

<Undercoat Layer>

In the present disclosure, the electrophotographic photosensitive member has an undercoat layer directly on the electro-conductive support. The undercoat layer in the present disclosure includes a titanium oxide particle that is surface-treated with at least one chemical compound represented by the following Formulae (A-1) to (A-10).

In the following Formulae (A-1) to (A-10), $R^1$ to $R^{10}$ represent a methyl group, an ethyl group or an acetyl group; $X^1$ to $X^5$ represent a hydrogen atom or a methyl group; and n is 1 to 7.

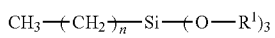

(A-1)

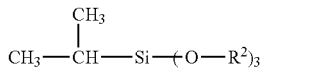

(A-2)

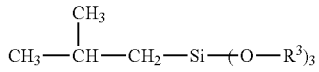

(A-3)

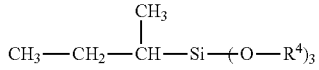

(A-4)

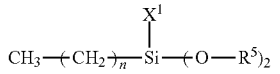

(A-5)

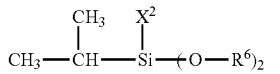

(A-6)

(A-7)

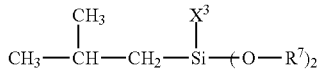

(A-8)

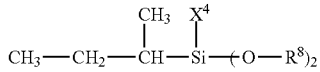

(A-9)

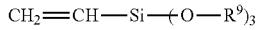

(A-10)

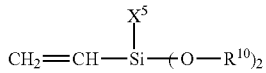

It is preferable that the undercoat layer of the present disclosure further contains a polyamide resin. The undercoat layer may contain a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamic acid resin, a polyimide resin, a polyamide-imide resin, a cellulose resin, or the like, in such a range as not to impair the effects of the present disclosure.

The particle size of the titanium oxide particles in the present disclosure are not limited in particular, but the particles having an average primary particle size of 500 nm or less are used. The average primary particle size of the particles used here is preferably 10 nm to 200 nm, and more preferably 20 nm to 100 nm.

A content of the titanium oxide particle in the undercoat layer in the present disclosure is not limited in particular, but it is preferable to be 10% by mass or more and 85% by mass or less, and is more preferable to be 15% by mass or more and 80% by mass or less, based on the total mass of the undercoat layer.

In addition, the undercoat layer may further contain an electron transport material, a metal oxide, a metal, an electro-conductive polymer or the like, for the purpose of improving electric characteristics, in such a range as not to impair the above effects.

The electron transport materials include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound and a boron-containing compound.

The metal oxides include indium tin oxide, tin oxide, indium oxide, titanium oxide, zinc oxide, aluminum oxide and silicon dioxide. The metals include gold, silver and aluminum.

In addition, the undercoat layer may also further contain an additive.

It is preferable for an average film thickness of the undercoat layer to be 0.1 μm or more and 50 μm or less, is more preferable to be 0.2 μm or more and 40 μm or less, and is particularly preferable to be 0.3 μm or more and 30 μm or less.

The undercoat layer can be formed by preparing a coating liquid for the undercoat layer containing the above materials and a solvent, forming its coating film, and drying and/or curing the coating film. The solvents to be used for the coating liquid include an alcohol solvent, a ketone solvent, an ether solvent, an ester solvent and an aromatic hydrocarbon solvent.

In the surface-treated titanium oxide contained in the undercoat layer, the chemical compound used for the surface treatment can be qualitatively determined by a known structural analysis method. The analysis method is not limited in particular, but the chemical compound can be analyzed by nuclear magnetic resonance spectroscopy, Fourier transform infrared spectroscopy, pyrolysis gas chromatography/mass spectrometry, time-of-flight secondary ion mass spectrometry, or the like.

When the chemical compound used for the surface treatment is analyzed, the electrophotographic photosensitive member can be processed into a sample form suitable for the analysis by pretreatment. A method of the pretreatment is not limited in particular, but a sample can be obtained, for example, by dissolving and removing the layers formed over the undercoat layer with a solvent to expose the undercoat layer, then extracting the undercoat layer with a solvent, and centrifuging and drying the extract.

<Photosensitive Layer>

The photosensitive layer of the electrophotographic photosensitive member of the present disclosure is a photosensitive multilayer, and has a charge generation layer containing a charge generation material and a charge transport layer containing a charge transport material.

<Charge Generation Layer>

It is preferable that the charge generation layer contains the charge generation material and a resin.

The charge generation materials include an azo pigment, a perylene pigment, a polycyclic quinone pigment, an indigo pigment and a phthalocyanine pigment. Among the pigments, the azo pigment and the phthalocyanine pigment are preferable. Among the phthalocyanine pigments, a titanium phthalocyanine crystal or a gallium phthalocyanine crystal is preferable.

In particular, titanyl phthalocyanine is more preferable which has a maximum diffraction peak of a Bragg angle, 2θ (±0.2°) at least at 27.2° with characteristic CuKα X-ray, from the viewpoint of stabilization of the exposure potential.

It is preferable for a content of the charge generation material in the charge generation layer to be 40% by mass or more and 85% by mass or less, and is more preferable to be 60% by mass or more and 80% by mass or less, with respect to a total mass of the charge generation layer.

The resins include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. Among the resins, the polyvinyl butyral resin is more preferable.

In addition, the charge generation layer may further contain additives such as an antioxidizing agent and an ultraviolet absorbing agent. Specific additives include a hindered phenol compound, a hindered amine compound, a sulfur compound, a phosphorus compound and a benzophenone compound.

It is preferable for the average film thickness of the charge generation layer to be 0.1 μm or more and 1 μm or less, and is more preferable to be 0.15 μm or more and 0.4 μm or less.

The charge generation layer can be formed by preparing a coating liquid for the charge generation layer containing the above materials and a solvent, forming its coating film on the undercoat layer, and drying the coating film. The solvents to be used for the coating liquid include an alcohol solvent, a sulfoxide solvent, a ketone solvent, an ether solvent, an ester solvent and an aromatic hydrocarbon solvent.

<Charge Transport Layer>

It is preferable that the charge transport layer contains a charge transport material and a resin.

The charge transport materials include a polycyclic aromatic compound, a heterocyclic compound, a hydrazone compound, a styryl compound, an enamine compound, a benzidine compound, a triarylamine compound, and resins having a group derived from these materials. Among the materials, the triarylamine compound or the benzidine compound is preferable from the viewpoint of potential stability during repeated use. In addition, a plurality of charge transport materials may be contained together.

Examples of the triarylamine compound will be shown below.

(CTM-1)

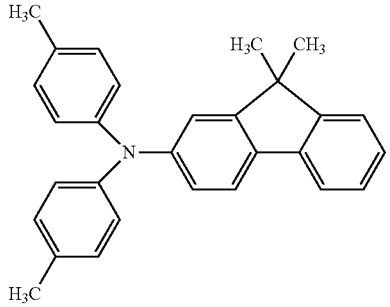

(CTM-2)

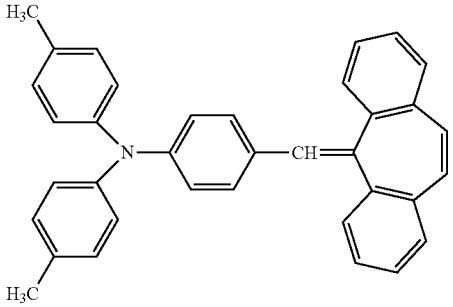

(CTM-3)

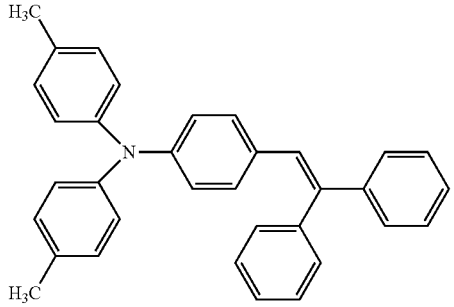

(CTM-4)

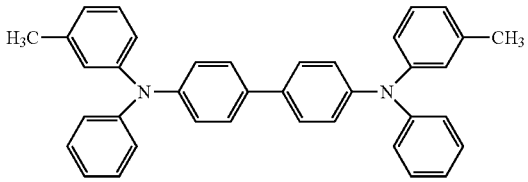

(CTM-5)

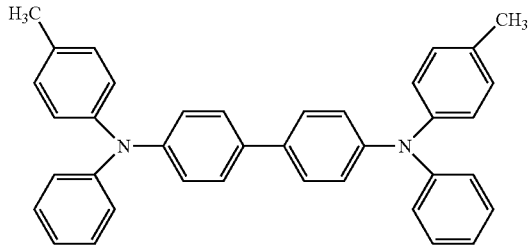

(CTM-6)

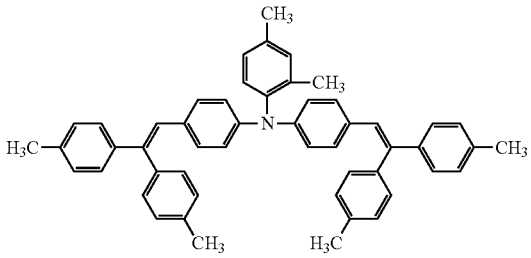

-continued (CTM-7)

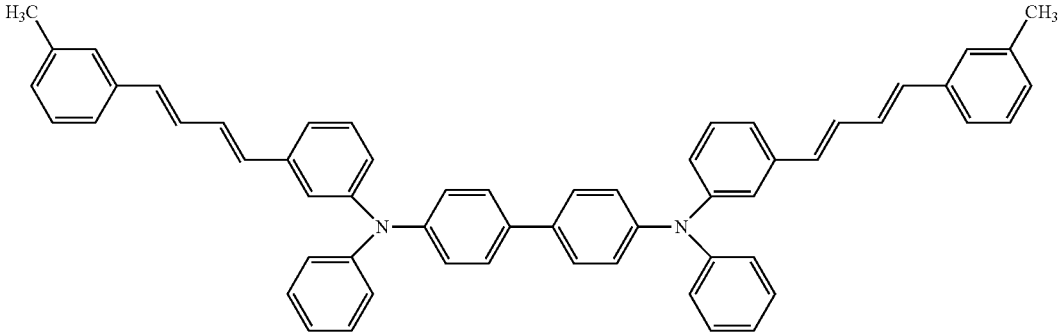

(CTM-8)

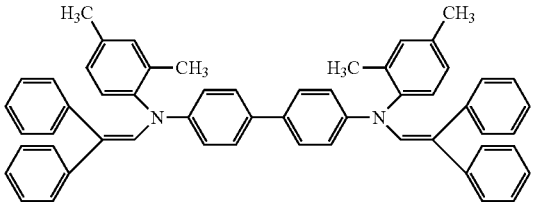

(CTM-9)

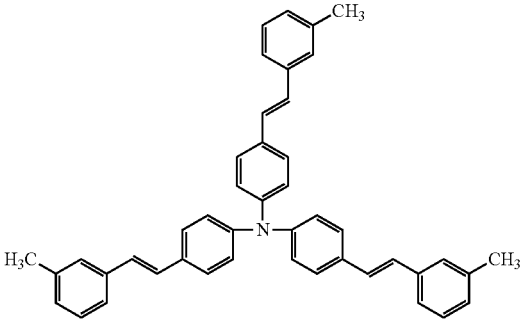

(CTM-10)

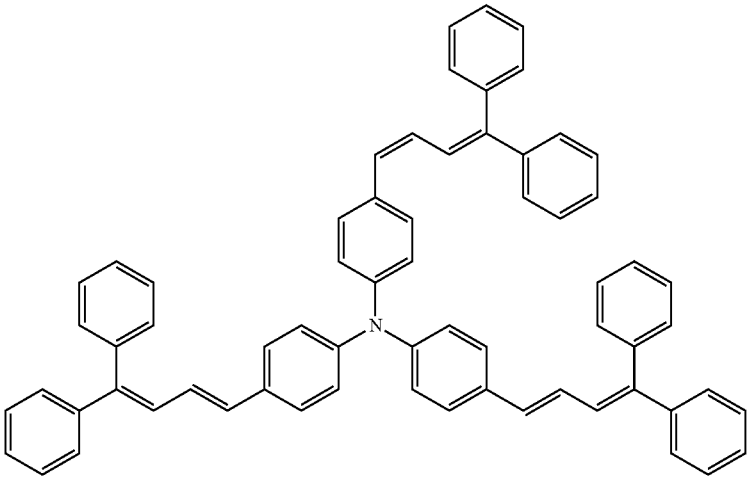

It is preferable for a content of the charge transport material in the charge transport layer to be 20% by mass or more and 60% by mass or less, and is more preferable to be 30% by mass or more and 50% by mass or less, with respect to the total mass of the charge transport layer.

A content ratio (mass ratio) between the charge transport material and the resin is preferably 4:10 to 20:10, and is more preferably 5:10 to 10:10.

The charge transport layer can be formed by forming a coating film from a coating liquid for the charge transport layer, which is prepared by dissolving the charge transport material and a binder resin in a solvent, and then drying the coating film. The solvents to be used for the coating liquid for forming the charge transport layer include an alcohol solvent, a sulfoxide solvent, a ketone solvent, an ether solvent, an ester solvent and an aromatic hydrocarbon solvent.

In addition, the charge transport layer may contain additives such as an antioxidizing agent, an ultraviolet absorbing agent, a plasticizing agent, a leveling agent, a slipperiness imparting agent and an abrasion resistance improver.

The specific additives include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, an alumina particle and a boron nitride particle.

It is preferable for an average film thickness of the charge transport layer to be 5 μm or more and 50 μm or less, is more preferable to be 8 μm or more and 40 μm or less, and is particularly preferable to be 10 μm or more and 30 μm or less.

The charge transport layer can be formed by preparing a coating liquid for the charge transport layer containing the above materials and a solvent, forming its coating film, and drying the coating film. The solvents to be used for the coating liquid include an alcohol solvent, a ketone solvent, an ether solvent, an ester solvent, and an aromatic hydrocarbon solvent. Among the above solvents, an ether solvent or an aromatic hydrocarbon solvent is preferable.

<Protective Layer>

In the electrophotographic photosensitive member of the present disclosure, a protective layer may be provided on the photosensitive layer in such a range as not to impair the effects of the present disclosure. By having the protective layer provided therein, the electrophotographic photosensitive member can improve its durability.

It is preferable that the protective layer contains an electro-conductive particle and/or a charge transport material, and a resin. The electro-conductive particles include particles of metal oxides such as titanium oxide, zinc oxide, tin oxide and indium oxide.

The charge transport materials include a polycyclic aromatic compound, a heterocyclic compound, a hydrazone compound, a styryl compound, an enamine compound, a benzidine compound, a triarylamine compound, and resins having a group derived from these materials. Among the materials, the triarylamine compound and the benzidine compound are preferable.

The resins include a polyester resin, an acrylic resin, a phenoxy resin, a polycarbonate resin, a polystyrene resin, a phenol resin, a melamine resin and an epoxy resin. Among the resins, the polycarbonate resin, the polyester resin and the acrylic resin are preferable.

In addition, the protective layer may be formed as a cured film by polymerization of a composition containing a monomer having a polymerizable functional group. Reactions at this time include a thermal polymerization reaction, a photopolymerization reaction, and a radiation-induced polymerization reaction. The polymerizable functional groups that the monomer having a polymerizable functional group has include an acryl group and a methacryl group. As a monomer having the polymerizable functional group, a material having charge transport capability may be used.

The protective layer may contain additives such as an antioxidizing agent, an ultraviolet absorbing agent, a plasticizing agent, a leveling agent, a slipperiness imparting agent and an abrasion resistance improver. The specific additives include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

It is preferable for an average film thickness of the protective layer to be 0.5 μm or more and 10 μm or less, and is preferable to be 1 μm or more and 7 μm or less.

The protective layer can be formed by preparing a coating liquid for the protective layer containing the above materials and a solvent, forming its coating film, and drying and/or curing the coating film. The solvents to be used for the coating liquid include an alcohol solvent, a ketone solvent, an ether solvent, a sulfoxide solvent, an ester solvent and an aromatic hydrocarbon solvent.

[Process Cartridge and Electrophotographic Apparatus]

The process cartridge of the present disclosure is characterized by integrally supporting the electrophotographic photosensitive member described above, and at least one unit selected from the group consisting of a charging unit, a developing unit, a transfer unit and a cleaning unit and being detachably attachable to a main body of the electrophotographic apparatus.

In addition, the electrophotographic apparatus of the present disclosure includes: the electrophotographic photosensitive member described above; a charging unit; an exposure unit; a developing unit; and a transfer unit.

FIG. 1 illustrates one example of a schematic configuration of an electrophotographic apparatus having a process cartridge 11 provided with an electrophotographic photosensitive member 1.

A cylindrical electrophotographic photosensitive member 1 is illustrated, and is rotationally driven around a shaft 2 in an arrow direction at a predetermined circumferential velocity. The surface of the electrophotographic photosensitive member 1 is charged to a predetermined positive or negative potential by a charging unit 3. For information, in the FIG. 1, a roller charging system by a roller charging member 3 is illustrated, but a charging system such as a corona charging system, a proximity charging system or an injection charging system may also be adopted. The surface of the charged electrophotographic photosensitive member 1 is irradiated with exposure light 4 emitted from an exposure unit (not illustrated), and an electrostatic latent image corresponding to objective image information is formed on the surface. The electrostatic latent image formed on the surface of the electrophotographic photosensitive member 1 is developed by a toner accommodated in a developing unit 5, and a toner image is formed on the surface of the electrophotographic photosensitive member 1. The toner image formed on the surface of the electrophotographic photosensitive member 1 is transferred onto a transfer material 7 by a transfer unit 6. The transfer material 7 having the toner image transferred thereon is conveyed to a fixing unit 8, is subjected to fixing treatment of the toner image, and is printed out to the outside of the electrophotographic apparatus. The electrophotographic apparatus may have a cleaning unit 9 for removing an adherent such as a toner remaining on the surface of the electrophotographic photosensitive member 1 after transferring. Alternatively, a cleaning unit may not be separately provided, but a so-called cleaner-less system may be used that removes the above adherent by a developing unit or the like. The electrophotographic apparatus may have a neutralization mechanism that subjects the surface of the electrophotographic photosensitive member 1 to neutralization treatment by pre-exposure light 10 emitted from a pre-exposure unit (not illustrated). In addition, a guiding unit 12 such as a rail may also be provided in order to detachably attach the process cartridge 11 of the present disclosure to a main body of the electrophotographic apparatus.

The electrophotographic photosensitive member of the present disclosure can be used in a laser beam printer, an LED printer, a copying machine, a facsimile, a combined machine thereof and the like.

[Example]

The present disclosure will be described in more detail below with reference to Examples and Comparative Examples, but the present disclosure is not limited to these Examples. Note that in the Examples and Comparative Examples, "part" means "part by mass".

<Manufacture Examples of Electro-Conductive Support>

<Electro-Conductive Support (1)>

An aluminum cylinder (JIS H4000: 2006A3003P, aluminum alloy) having a diameter of 20 mm and a length of 254.8 mm was prepared by hot extrusion. The aluminum cylinder was subjected to cutting work with a diamond sintered tool.

The cylinder was subjected sequentially to degreasing treatment, etching treatment in a 2 wt % solution of sodium hydroxide for 1 minute, neutralization treatment and pure water washing, as a cleaning process.

Next, the cleaned cylinder was subjected to anodic oxidation in a 10 wt % solution of sulfuric acid at a current density of 1.0 A/dm$^2$ for 20 minutes, and an anodic oxide film was formed on the surface of the cylinder. Next, the anodized cylinder was washed with water, and then was immersed in a 1 wt % solution of nickel acetate at 80° C. for 15 minutes to be sealed. Furthermore, the cylinder was subjected to pure water washing and drying treatment, and an electro-conductive support (1) was obtained.

<Electro-Conductive Supports (2) to (5)>

The electro-conductive supports (2) to (5) were manufactured in the same manner as in the electro-conductive support (1), except that the treatment time of the anodic oxidation in the 10 wt % solution of sulfuric acid in the manufacture example of the electro-conductive support (1) was changed to each of the treatment times shown in Table 1.

<Electro-Conductive Supports (6) and (7)>

The electro-conductive supports (6) and (7) were manufactured in the same manner as in the electro-conductive support (1), except that in the manufacture example of the electro-conductive support (1), the aluminum cylinder was not subjected to the cutting work, and the treatment time of the anodic oxidation was changed to each of the treatment times shown in Table 1.

<Electro-Conductive Support (8)>

An electro-conductive support (8) was manufactured in the same manner as in the electro-conductive support (1), except that the anodic oxide film was not formed and the sealing treatment was not performed, in the manufacture example of the electro-conductive support (1).

TABLE 1

| Electro-conductive support | Presence or absence of cutting work | Anodizing time (min) |
|---|---|---|
| Electro-conductive support (1) | Present | 20 |
| Electro-conductive support (2) | Present | 2 |
| Electro-conductive support (3) | Present | 5 |
| Electro-conductive support (4) | Present | 30 |
| Electro-conductive support (5) | Present | 40 |

TABLE 1-continued

| Electro-conductive support | Presence or absence of cutting work | Anodizing time (min) |
|---|---|---|
| Electro-conductive support (6) | Absent | 20 |
| Electro-conductive support (7) | Absent | 40 |
| Electro-conductive support (8) | Present | No anodization |

[Production Examples of Coating Liquid for Undercoat Layer]

<Coating Liquid (1) for Undercoat Layer>

One hundred (100) parts of rutile-type titanium oxide particles (average primary particle size: 50 nm, produced by Tayca Corporation) were stirred and mixed with 500 parts of toluene, and 3.0 parts of ethyl trimethoxy silane was added thereto as a chemical compound represented by the following Formula (A-1) where n is 1 and $R^1$ is a methyl group, and the mixture was stirred for 8 hours. Then, toluene was evaporated under reduced pressure, the residue was dried at 120° C. for 3 hours to obtain rutile-type titanium oxide particles surface-treated with ethyl trimethoxy silane.

$$CH_3-(CH_2)_n-Si-(O-R^1)_3 \quad \text{(A-1)}$$

Eighteen (18) parts of the rutile-type titanium oxide particles surface-treated with ethyl trimethoxy silane, 4.5 parts of N-methoxymethylated nylon (trade name: Tresin EF-30T, produced by Nagase ChemteX Corporation), and 1.5 parts of a copolymerized nylon resin (trade name: Amilan™ CM8000, produced by Toray Industries, Inc.) were added to a mixed solvent of 90 parts of methanol, 60 parts of 1-butanol and 15 parts of dimethyl ketone acetone, and a dispersion liquid was prepared. This dispersion liquid was subjected to dispersion treatment in a vertical sand mill with glass beads having a diameter of 1.0 mm for 5 hours to produce a coating liquid (1) for an undercoat layer.

<Coating Liquids (2) to (24) for Undercoat Layers>

Coating liquids (2) to (24) for undercoat layers were produced in the same manner as the coating liquid (1) for the undercoat layer, except that chemical compounds used for surface treatment of the rutile-type titanium oxide particle were changed to the respective compounds shown in Table 2.

TABLE 2

| Coating liquid for undercoat layer | General formula of surface treatment compound | n | R | X |
|---|---|---|---|---|
| Coating liquid for undercoat layer (1) | (A-1) | 1 | $R^1 = CH_3$ | — |
| Coating liquid for undercoat layer (2) | (A-1) | 2 | $R^1 = CH_3$ | — |
| Coating liquid for undercoat layer (3) | (A-1) | 3 | $R^1 = CH_3$ | — |
| Coating liquid for undercoat layer (4) | (A-1) | 4 | $R^1 = CH_3$ | — |
| Coating liquid for undercoat layer (5) | (A-1) | 5 | $R^1 = CH_3$ | — |
| Coating liquid for undercoat layer (6) | (A-1) | 6 | $R^1 = CH_3$ | — |
| Coating liquid for undercoat layer (7) | (A-1) | 7 | $R^1 = CH_3$ | — |
| Coating liquid for undercoat layer (8) | (A-1) | 1 | $R^1 = C_2H_5$ | — |
| Coating liquid for undercoat layer (9) | (A-2) | — | $R^2 = CH_3$ | — |
| Coating liquid for undercoat layer (10) | (A-3) | — | $R^3 = CH_3$ | — |
| Coating liquid for undercoat layer (11) | (A-4) | — | $R^4 = CH_3$ | — |
| Coating liquid for undercoat layer (12) | (A-5) | 1 | $R^5 = CH_3$ | $X^1 = H$ |
| Coating liquid for undercoat layer (13) | (A-5) | 2 | $R^5 = CH_3$ | $X^1 = H$ |
| Coating liquid for undercoat layer (14) | (A-5) | 3 | $R^5 = CH_3$ | $X^1 = H$ |
| Coating liquid for undercoat layer (15) | (A-5) | 4 | $R^5 = CH_3$ | $X^1 = H$ |
| Coating liquid for undercoat layer (16) | (A-5) | 5 | $R^5 = CH_3$ | $X^1 = H$ |
| Coating liquid for undercoat layer (17) | (A-5) | 6 | $R^5 = CH_3$ | $X^1 = H$ |
| Coating liquid for undercoat layer (18) | (A-5) | 7 | $R^5 = CH_3$ | $X^1 = H$ |

TABLE 2-continued

| Coating liquid for undercoat layer | General formula of surface treatment compound | n | R | X |
|---|---|---|---|---|
| Coating liquid for undercoat layer (19) | (A-5) | 1 | $R^5 = C_2H_5$ | $X^1 = H$ |
| Coating liquid for undercoat layer (20) | (A-6) | — | $R^6 = CH_3$ | $X^2 = H$ |
| Coating liquid for undercoat layer (21) | (A-7) | — | $R^7 = CH_3$ | $X^3 = H$ |
| Coating liquid for undercoat layer (22) | (A-8) | — | $R^8 = CH_3$ | $X^4 = H$ |
| Coating liquid for undercoat layer (23) | (A-9) | — | $R^9 = CH_3$ | — |
| Coating liquid for undercoat layer (24) | (A-10) | — | $R^{10} = CH_3$ | $X^5 = H$ |

<Coating Liquid (25) for Undercoat Layer>

One hundred (100) parts of rutile-type titanium oxide particles (average primary particle size: 50 nm, produced by Tayca Corporation) were mixed and stirred with 500 parts of toluene, and 3.0 parts of ethyl trimethoxy silane was added thereto as a chemical compound represented by the following Formula (A-1) where n is 1 and $R^1$ is a methyl group, and the mixture was stirred for 8 hours. Then, toluene was evaporated under reduced pressure, and the residue was dried at 120° C. for 3 hours to obtain rutile-type titanium oxide particles surface-treated with ethyl trimethoxy silane.

$$CH_3-(CH_2)_n-Si-(O-R^1)_3 \quad \text{(A-1)}$$

Eighteen (18) parts of the rutile-type titanium oxide particles surface-treated with ethyl trimethoxy silane, 3 parts of an alkyd resin (Beckolite M6401-50-S, produced by Dainippon Ink and Chemicals, Inc.), and 3 parts of a melamine resin (Super Beckamine L-121-60, produced by Dainippon Ink and Chemicals, Inc.) were added to 165 parts of 2-butanone to prepare a dispersion liquid. This dispersion liquid was subjected to dispersion treatment in a vertical sand mill with glass beads having a diameter of 1.0 mm for 5 hours, and a coating liquid (1) for the undercoat layer was prepared.

<Coating Liquid (26) for Undercoat Layer>

A coating liquid (26) for the undercoat layer was produced in the same manner as the coating liquid (1) for the undercoat layer, except that methyl trimethoxy silane was used as the chemical compound for surface treatment of the rutile-type titanium oxide particle.

<Coating Liquid (27) for Undercoat Layer>

A coating liquid (27) for the undercoat layer was produced in the same manner as in the coating liquid (1) for the undercoat layer, except that the rutile-type titanium oxide particle was used without being subjected to surface treatment.

[Production Example of Coating Liquid for Charge Generation Layer]

<Coating Liquid for Charge Generation Layer>

A titanium phthalocyanine crystal (charge generation material) was prepared which had a peak of a Bragg angle, 2θ±0.3° at 27.2° in CuKα X-ray diffraction. The titanium phthalocyanine crystal in an amount of 1 part, a polyvinyl butyral resin (trade name: S-LEC BX-1, hydroxyl value: 173 mgKOH/g, produced by Sekisui Chemical Co., Ltd.) in an amount of 1 part and tetrahydrofuran in an amount of 100 parts were subjected to dispersion treatment by an ultrasonic disperser for 15 minutes, and a coating liquid for a charge generation layer was prepared.

[Production Example of Coating Liquid for Charge Transport Layer]

<Coating Liquid for Charge Transport Layer>

Four (4) parts of an amine compound (charge transport material) represented by (CTM-4), 4 parts of an amine compound represented by (CTM-5), and 10 parts of a polycarbonate resin (Iupilon Z-400, manufactured by Mitsubishi Gas Chemical Company, Inc.) were dissolved in a mixed solvent of 35 parts of dimethoxymethane and 75 parts of chlorobenzene to prepare a coating liquid for a charge transport layer.

[Manufacture Examples of Electrophotographic Photosensitive Member]

<Electrophotographic Photosensitive Member (1)>

The electro-conductive support (1) was dip-coated with the coating liquid (1) for the undercoat layer; the obtained coating film was dried at 100° C. for 10 minutes, and then was additionally dried for 10 minutes while the temperature was lowered to 95° C. from 100° C. to form an undercoat layer having a film thickness of 2.2 μm.

Subsequently, the above undercoat layer was dip-coated with the coating liquid for the charge generation layer, and the obtained coating film was dried at 100° C. for 10 minutes to form the charge generation layer having a film thickness of 0.27 μm.

Subsequently, the above charge generation layer was dip-coated with the coating liquid for the charge transport layer, and the obtained coating film was dried at 125° C. for 30 minutes to form the charge transport layer having a film thickness of 15 μm.

As described above, an electrophotographic photosensitive member (1) was manufactured which had the undercoat layer, the charge generation layer and the charge transport layer on the electro-conductive support.

<Electrophotographic Photosensitive Members (2) to (34)>

Electrophotographic photosensitive members (2) to (34) were obtained in the same manner as in the method of manufacturing the electrophotographic photosensitive member (1), except that the respective electro-conductive supports and the respective compositions of the coating liquids for the undercoat layers were changed to those shown in Table 3.

TABLE 3

| Electrophotographic photosensitive member | Electro-conductive support | Coating liquid for undercoat layer |
|---|---|---|
| Electrophotographic photosensitive member (1) | Electro-conductive support (1) | Coating liquid for undercoat layer (1) |
| Electrophotographic photosensitive member (2) | Electro-conductive support (1) | Coating liquid for undercoat layer (2) |

TABLE 3-continued

| Electrophotographic photosensitive member | Electro-conductive support | Coating liquid for undercoat layer |
|---|---|---|
| Electrophotographic photosensitive member (3) | Electro-conductive support (1) | Coating liquid for undercoat layer (3) |
| Electrophotographic photosensitive member (4) | Electro-conductive support (1) | Coating liquid for undercoat layer (4) |
| Electrophotographic photosensitive member (5) | Electro-conductive support (1) | Coating liquid for undercoat layer (5) |
| Electrophotographic photosensitive member (6) | Electro-conductive support (1) | Coating liquid for undercoat layer (6) |
| Electrophotographic photosensitive member (7) | Electro-conductive support (1) | Coating liquid for undercoat layer (7) |
| Electrophotographic photosensitive member (8) | Electro-conductive support (1) | Coating liquid for undercoat layer (8) |
| Electrophotographic photosensitive member (9) | Electro-conductive support (1) | Coating liquid for undercoat layer (9) |
| Electrophotographic photosensitive member (10) | Electro-conductive support (1) | Coating liquid for undercoat layer (10) |
| Electrophotographic photosensitive member (11) | Electro-conductive support (1) | Coating liquid for undercoat layer (11) |
| Electrophotographic photosensitive member (12) | Electro-conductive support (1) | Coating liquid for undercoat layer (12) |
| Electrophotographic photosensitive member (13) | Electro-conductive support (1) | Coating liquid for undercoat layer (13) |
| Electrophotographic photosensitive member (14) | Electro-conductive support (1) | Coating liquid for undercoat layer (14) |
| Electrophotographic photosensitive member (15) | Electro-conductive support (1) | Coating liquid for undercoat layer (15) |
| Electrophotographic photosensitive member (16) | Electro-conductive support (1) | Coating liquid for undercoat layer (16) |
| Electrophotographic photosensitive member (17) | Electro-conductive support (1) | Coating liquid for undercoat layer (17) |
| Electrophotographic photosensitive member (18) | Electro-conductive support (1) | Coating liquid for undercoat layer (18) |
| Electrophotographic photosensitive member (19) | Electro-conductive support (1) | Coating liquid for undercoat layer (19) |
| Electrophotographic photosensitive member (20) | Electro-conductive support (1) | Coating liquid for undercoat layer (20) |
| Electrophotographic photosensitive member (21) | Electro-conductive support (1) | Coating liquid for undercoat layer (21) |
| Electrophotographic photosensitive member (22) | Electro-conductive support (1) | Coating liquid for undercoat layer (22) |
| Electrophotographic photosensitive member (23) | Electro-conductive support (1) | Coating liquid for undercoat layer (23) |
| Electrophotographic photosensitive member (24) | Electro-conductive support (1) | Coating liquid for undercoat layer (24) |
| Electrophotographic photosensitive member (25) | Electro-conductive support (1) | Coating liquid for undercoat layer (25) |
| Electrophotographic photosensitive member (26) | Electro-conductive support (2) | Coating liquid for undercoat layer (1) |
| Electrophotographic photosensitive member (27) | Electro-conductive support (3) | Coating liquid for undercoat layer (1) |
| Electrophotographic photosensitive member (28) | Electro-conductive support (4) | Coating liquid for undercoat layer (1) |
| Electrophotographic photosensitive member (29) | Electro-conductive support (5) | Coating liquid for undercoat layer (1) |
| Electrophotographic photosensitive member (30) | Electro-conductive support (6) | Coating liquid for undercoat layer (1) |
| Electrophotographic photosensitive member (31) | Electro-conductive support (7) | Coating liquid for undercoat layer (25) |
| Electrophotographic photosensitive member (32) | Electro-conductive support (8) | Coating liquid for undercoat layer (1) |
| Electrophotographic photosensitive member (33) | Electro-conductive support (1) | Coating liquid for undercoat layer (26) |
| Electrophotographic photosensitive member (34) | Electro-conductive support (1) | Coating liquid for undercoat layer (27) |

[Exposure Potential after Storage in High-Temperature and High-Humidity Environment]

The obtained electrophotographic photosensitive member was mounted on a process cartridge for HP Color Laser JetPro M452dn (manufactured by Hewlett-Packard Company), and was modified so as to mount a potential probe (trade name: model 6000B-8, manufactured by Trek Japan) on the developing position. After that, the potential of the exposed portion at the central portion (position of approximately 127 mm) of the electrophotographic photosensitive member was measured with a surface electrometer (trade name: model 344, manufactured by Trek Japan).

Firstly, the initial potential (VI0) of the exposed portion was measured at 23.0° C. in 50% RH environment. As the potential of the exposed portion, a potential was measured at the time when the charging potential (Vd) was set at −600 V and the amount of light for image exposure was set at 0.30 $\mu J/cm^2$.

Next, the electrophotographic photosensitive member was stored at 50.0° C. in 95% RH environment for 3 days, then was taken out, and was left for 1 day at 23.0° C. in 50% RH environment. On the electrophotographic photosensitive member after the storage, the potential (VI1) of the exposed portion was measured in the same manner as described above, at the time when the charging potential (Vd) was set at −600 V and the amount of light for image exposure was set at 0.30 $\mu J/cm^2$.

Finally, the potential difference ΔVl before and after the storage was calculated based on the following Expression (2).

$$\Delta Vl = |Vl1 - Vl0| \quad \text{Expression (2)}$$

The method for measuring the above exposure potential after the storage in the high-temperature and high-humidity environment will be denoted as "Evaluation 4".

[Evaluation of Black Spot after Storage in High-Temperature and High-Humidity Environment]

The obtained electrophotographic photosensitive member was stored at 50.0° C. in 95% RH environment for 3 days, then was taken out, and was left for 1 day at 23.0° C. in 50% RH environment. The electrophotographic photosensitive member after storage was mounted on a process cartridge for HP Color Laser JetPro M452dn (manufactured by Hewlett-Packard Company), and a halftone image was output. The evaluation for the black spot was ranked as described below, based on the output results of the halftone images.

Rank 1: There is one black spot in a range of one perimeter of the photosensitive member.

Rank 2: There are two black spots in the range of one perimeter of the photosensitive member.

Rank 3: There are three black spots in the range of one perimeter of the photosensitive member.

Rank 4: There are four black spots in the range of one perimeter of the photosensitive member.

Rank 5: There are five or more black spots in the range of one perimeter of the photosensitive member.

The above method for evaluating the black spot will be denoted as "Evaluation 5".

EXAMPLE

Example 1

The potential difference ΔVl based on the evaluation 4 was calculated for the electrophotographic photosensitive member (1), and the result was 3 V. Furthermore, the black spot was evaluated based on the Evaluation 5, and the result was rank 1.

In addition, from the surface of the electrophotographic photosensitive member (1), the charge transport layer and the charge generation layer were wiped off with a waste (for example, Kimwipe™ (produced by Kimberly-Clark Corporation)) impregnated with an ester solvent (for example, ethyl acetate (produced by Nippon Synthetic Chemical Industry Co., Ltd.)), and the resultant was then dried at 100° C. for 30 minutes to expose the undercoat layer.

Furthermore, the exposed undercoat layer was wiped off with a waste (for example, Kimwipe™ (produced by Kimberly-Clark Corporation)) impregnated with an alcohol solvent (for example, methanol (produced by Nippon Synthetic Chemical Industry Co., Ltd.), and the resultant was then dried at 100° C. for 30 minutes to expose the electro-conductive support. The atomic concentration ratio R on the electro-conductive support was measured, based on the Evaluation 1, and as a result, R was 1.75. Furthermore, the length L of the region based on the Evaluation 2 was measured, and as a result, L was 6.0 μm. Furthermore, the arithmetic average roughness Sa was measured, based on the Evaluation 3, and as a result, Sa was 1.1 μm.

By using the above electrophotographic photosensitive member (1), the occurrence of the black spot in the charged portion and the deterioration in sensitivity of the exposed portion were simultaneously suppressed, even after it was stored in the high-temperature and high-humidity environment.

Examples 2 to 31

Examples 2 to 31 were evaluated in the same manner as in Example 1, except that in each of the Evaluations 1 to 5, the electrophotographic photosensitive member in Example 1 was replaced with the respective electrophotographic photosensitive members shown in Table 4. The obtained results are shown in Table 4. Also in Examples 2 to 31, similarly to Example 1, the occurrence of the black spot in the charged portion and the deterioration in sensitivity of the exposed portion were simultaneously suppressed, even after each of the electrophotographic photosensitive members was stored in the high-temperature and high-humidity environment.

Comparative Examples 1 to 3

Comparative Examples 1 to 3 were evaluated in the same manner as in Example 1, except that in each of the Evaluations 1 to 5, the electrophotographic photosensitive member in Example 1 was replaced with the respective electrophotographic photosensitive members shown in Table 4. The obtained results are shown in Table 4.

TABLE 4

| Example | Electrophotographic photosensitive member | Evaluation 1 R | Evaluation 2 L (μm) | evaluation 3 Sa (μm) | Initial potential VI0 | Evaluation 4 ΔVI | Evaluation 5 Rank of black spot |
|---|---|---|---|---|---|---|---|
| Example (1) | Electrophotographic photosensitive member (1) | 1.75 | 6.0 | 1.1 | −120 | 3 | 1 |
| Example (2) | Electrophotographic photosensitive member (2) | 1.75 | 6.0 | 1.1 | −121 | 3 | 1 |
| Example (3) | Electrophotographic photosensitive member (3) | 1.75 | 6.0 | 1.1 | −124 | 2 | 1 |
| Example (4) | Electrophotographic photosensitive member (4) | 1.75 | 6.0 | 1.1 | −123 | 2 | 1 |
| Example (5) | Electrophotographic photosensitive member (5) | 1.75 | 6.0 | 1.1 | −126 | 2 | 1 |
| Example (6) | Electrophotographic photosensitive member (6) | 1.75 | 6.0 | 1.1 | −128 | 2 | 1 |
| Example (7) | Electrophotographic photosensitive member (7) | 1.75 | 6.0 | 1.1 | −128 | 1 | 1 |
| Example (8) | Electrophotographic photosensitive member (8) | 1.75 | 6.0 | 1.1 | −120 | 2 | 1 |
| Example (9) | Electrophotographic photosensitive member (9) | 1.75 | 6.0 | 1.1 | −121 | 2 | 2 |
| Example (10) | Electrophotographic photosensitive member (10) | 1.75 | 6.0 | 1.1 | −124 | 2 | 1 |
| Example (11) | Electrophotographic photosensitive member (11) | 1.75 | 6.0 | 1.1 | −123 | 2 | 1 |
| Example (12) | Electrophotographic photosensitive member (12) | 1.75 | 6.0 | 1.1 | −122 | 2 | 2 |
| Example (13) | Electrophotographic photosensitive member (13) | 1.75 | 6.0 | 1.1 | −123 | 2 | 1 |
| Example (14) | Electrophotographic photosensitive member (14) | 1.75 | 6.0 | 1.1 | −123 | 2 | 1 |

TABLE 4-continued

| Example | Electrophotographic photosensitive member | Evaluation 1 R | Evaluation 2 L (μm) | evaluation 3 Sa (μm) | Initial potential VI0 | Evaluation 4 ΔVI | Evaluation 5 Rank of black spot |
|---|---|---|---|---|---|---|---|
| Example (15) | Electrophotographic photosensitive member (15) | 1.75 | 6.0 | 1.1 | −124 | 1 | 1 |
| Example (16) | Electrophotographic photosensitive member (16) | 1.75 | 6.0 | 1.1 | −124 | 1 | 1 |
| Example (17) | Electrophotographic photosensitive member (17) | 1.75 | 6.0 | 1.1 | −126 | 2 | 1 |
| Example (18) | Electrophotographic photosensitive member (18) | 1.75 | 6.0 | 1.1 | −129 | 1 | 1 |
| Example (19) | Electrophotographic photosensitive member (19) | 1.75 | 6.0 | 1.1 | −123 | 2 | 1 |
| Example (20) | Electrophotographic photosensitive member (20) | 1.75 | 6.0 | 1.1 | −123 | 1 | 2 |
| Example (21) | Electrophotographic photosensitive member (21) | 1.75 | 6.0 | 1.1 | −123 | 3 | 1 |
| Example (22) | Electrophotographic photosensitive member (22) | 1.75 | 6.0 | 1.1 | −124 | 2 | 1 |
| Example (23) | Electrophotographic photosensitive member (23) | 1.75 | 6.0 | 1.1 | −118 | 4 | 2 |
| Example (24) | Electrophotographic photosensitive member (24) | 1.75 | 6.0 | 1.1 | −121 | 3 | 2 |
| Example (25) | Electrophotographic photosensitive member (25) | 1.75 | 6.0 | 1.1 | −120 | 3 | 2 |
| Example (26) | Electrophotographic photosensitive member (26) | 1.62 | 0.6 | 1.2 | −120 | 6 | 3 |
| Example (27) | Electrophotographic photosensitive member (27) | 1.76 | 1.4 | 0.9 | −120 | 4 | 2 |
| Example (28) | Electrophotographic photosensitive member (28) | 1.78 | 9.0 | 1.0 | −126 | 3 | 1 |
| Example (29) | Electrophotographic photosensitive member (29) | 1.77 | 12.0 | 1.1 | −129 | 2 | 1 |
| Example (30) | Electrophotographic photosensitive member (30) | 1.67 | 6.5 | 6.3 | −120 | 4 | 2 |
| Example (31) | Electrophotographic photosensitive member (31) | 1.78 | 11.5 | 6.5 | −121 | 5 | 2 |
| Comparative Example (1) | Electrophotographic photosensitive member (32) | 0.10 | — | 1.0 | −121 | 35 | 5 |
| Comparative Example (2) | Electrophotographic photosensitive member (33) | 1.75 | 6.0 | 1.1 | −119 | 30 | 6 |
| Comparative Example (3) | Electrophotographic photosensitive member (34) | 1.75 | 6.0 | 1.1 | −119 | 39 | 5 |

According to the present disclosure, there can be provided an electrophotographic photosensitive member that can simultaneously achieve the suppression of the occurrence of the black spot in the charged portion and the suppression of the deterioration in sensitivity of the exposed portion, even after stored in the high-temperature and high-humidity environment.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-111486, filed Jun. 14, 2019, which is hereby incorporated by reference herein in its entirety.

What is claimed is:

1. An electrophotographic photosensitive member comprising an electro-conductive support, an undercoat layer, a charge generation layer and a charge transport layer in this order, wherein an atomic concentration ratio R of an oxygen atom to an aluminum atom on a surface of the electro-conductive support, as measured by energy dispersive X-ray spectroscopy, satisfies the following Expression (1):

$$1.6 \leq R \quad (1)$$

and the undercoat layer comprises a titanium oxide particle that is surface-treated with at least one chemical compound represented by the following Formulae (A-1) to (A-10), wherein $R^1$ to $R^{10}$ represent a methyl group, an ethyl group or an acetyl group; $X^1$ to $X^5$ represent a hydrogen atom or a methyl group; and n is 1 to 7

(A-1)

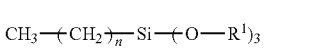

(A-2)

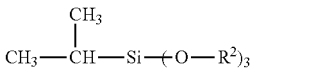

(A-3)

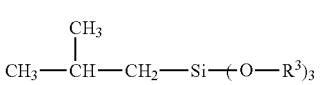

(A-4)

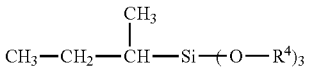

(A-5)

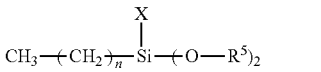

(A-6)

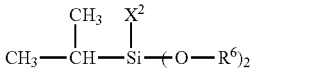

(A-7)

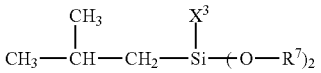

(A-8)

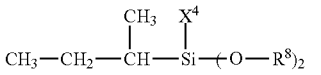

(A-9)

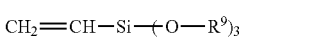

(A-10)

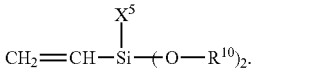

2. The electrophotographic photosensitive member according to claim 1, wherein a length of a region that satisfies the Expression (1) in the electro-conductive support is 1 μm or more and 10 μm or less from the surface of the electro-conductive support.

3. The electrophotographic photosensitive member according to claim 1, wherein an arithmetic average roughness Sa of the surface of the electro-conductive support is 3 μm or less.

4. The electrophotographic photosensitive member according to claim 1, wherein the undercoat layer comprises a polyamide resin.

5. The electrophotographic photosensitive member according to claim 1, wherein the charge generation layer comprises a charge generation material, wherein the charge generation material is titanyl phthalocyanine that has a maximum diffraction peak at least at 27.2° as diffraction peak (±0.2°) of a Bragg angle, 2θ for characteristic CuKα X-ray.

6. A process cartridge, wherein the process cartridge integrally supports an electrophotographic photosensitive member having an electro-conductive support, an undercoat layer, a charge generation layer and a charge transport layer in this order, and at least one unit selected from the group consisting of a charging unit, a developing unit and a cleaning unit, and is detachably attachable to a main body of an electrophotographic apparatus, wherein an atomic concentration ratio R of an oxygen atom to an aluminum atom on a surface of the electro-conductive support, as measured by energy dispersive X-ray spectroscopy, satisfies the following Expression (1):

$$1.6 \leq R \quad (1)$$

and the undercoat layer comprises a titanium oxide particle that is surface-treated with at least one chemical compound represented by the following Formulae (A-1) to (A-10), wherein $R^1$ to $R^{10}$ represent a methyl group, an ethyl group or an acetyl group; $X^1$ to $X^5$ represent a hydrogen atom or a methyl group; and n is 1 to 7

(A-1)

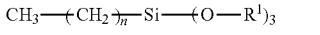

(A-2)

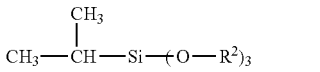

(A-3)

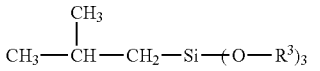

(A-4)

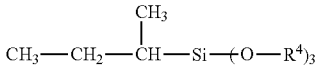

(A-5)

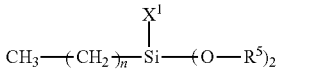

(A-6)

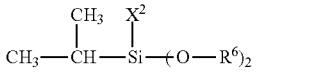

(A-7)

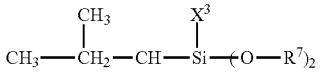

(A-8)

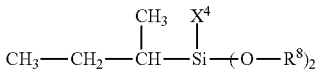

(A-9)

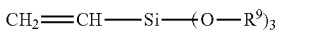

(A-10)

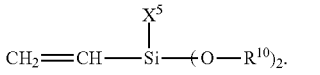

7. An electrophotographic apparatus comprising: an electrophotographic photosensitive member having an electro-conductive support, an undercoat layer, a charge generation layer and a charge transport layer in this order; and at least one unit selected from the group consisting of a charging unit, an exposure unit, a developing unit and a transfer unit, wherein an atomic concentration ratio R of an oxygen atom to an aluminum atom on a surface of the electro-conductive support, as measured by energy dispersive X-ray spectroscopy, satisfies the following Expression (1):

$$1.6 \leq R \quad (1)$$

and the undercoat layer comprises a titanium oxide particle that is surface-treated with at least one chemical compound represented by the following Formulae (A-1) to (A-10), wherein $R^1$ to $R^{10}$ represent a methyl group, an ethyl group or an acetyl group; $X^1$ to $X^5$ represent a hydrogen atom or a methyl group; and n is 1 to 7

(A-1)

(A-2)

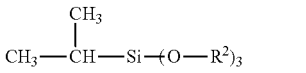

(A-3)

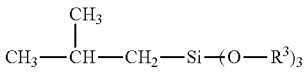

(A-4)

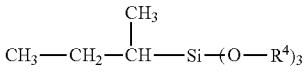

(A-5)

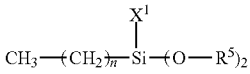

(A-6)

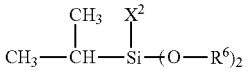

(A-7)

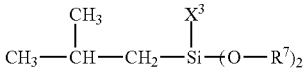

(A-8)

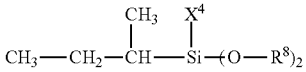

(A-9)

(A-10)

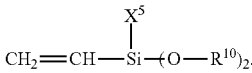

8. An electrophotographic photosensitive member comprising an electro-conductive support, an undercoat layer, a charge generation layer and a charge transport layer in this order, wherein an atomic concentration ratio R of an oxygen atom to an aluminum atom on a surface of the electro-conductive support, as measured by energy dispersive X-ray spectroscopy, satisfies the following Expression (1):

$$1.6 \leq R \quad (1)$$

and the undercoat layer comprises a titanium oxide particle, and the titanium oxide particle has at least one organic functional group represented by the following Formulae (B-1) to (B-10) on the surface, wherein $R^{11}$ to $R^{20}$ represent a methyl group, an ethyl group or an acetyl group; $X^6$ to $X^{10}$ represent a hydrogen atom or a methyl group; x is an integer of 1 to 7; y is an integer of 1 to 3; z is an integer of 1 to 2; and the organic functional group is bonded to the surface of the titanium oxide particle at *

(B-1)

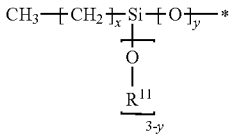

(B-2)

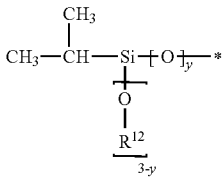

(B-3)

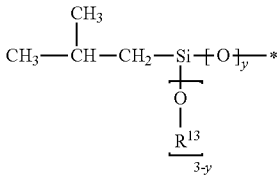

(B-4)

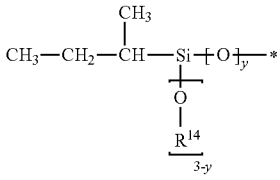

(B-5)

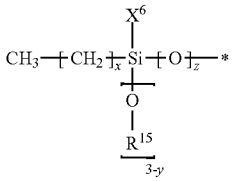

(B-6)

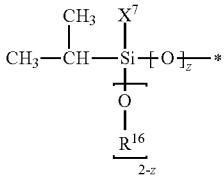

(B-7)

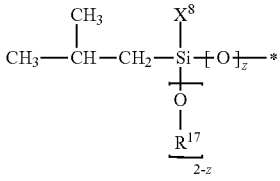

(B-8)

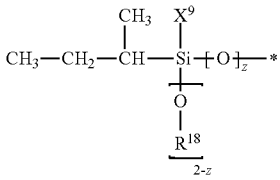

(B-9)

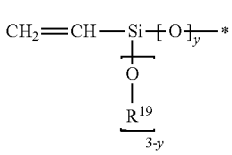

-continued (B-10)

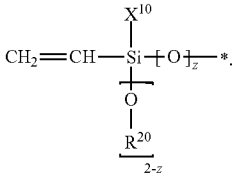

9. A process cartridge, wherein the process cartridge integrally supports an electrophotographic photosensitive member having an electro-conductive support, an undercoat layer, a charge generation layer and a charge transport layer in this order, and at least one unit selected from the group consisting of a charging unit, a developing unit and a cleaning unit, and is detachably attachable to a main body of an electrophotographic apparatus, wherein an atomic concentration ratio R of an oxygen atom to an aluminum atom on a surface of the electro-conductive support, as measured by energy dispersive X-ray spectroscopy, satisfies the following Expression (1):

$$1.6 \leq R \quad (1)$$

and the undercoat layer comprises a titanium oxide particle, and the titanium oxide particle has at least one organic functional group represented by the following Formulae (B-1) to (B-10) on the surface, wherein $R^{11}$ to $R^{20}$ represent a methyl group, an ethyl group or an acetyl group; $X^6$ to $X^{10}$ represent a hydrogen atom or a methyl group; x is an integer of 1 to 7; y is an integer of 1 to 3; z is an integer of 1 to 2; and the organic functional group is bonded to the surface of the titanium oxide particle at *

(B-1)

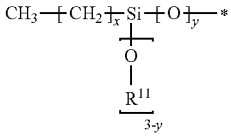

(B-2)

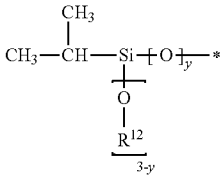

(B-3)

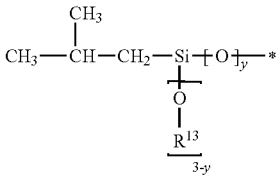

(B-4)

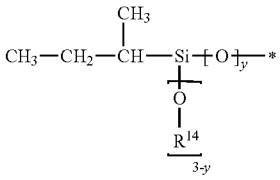

-continued (B-5)

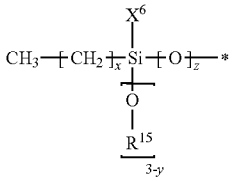

(B-6)

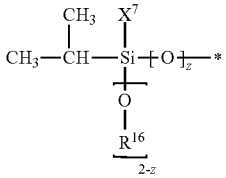

(B-7)

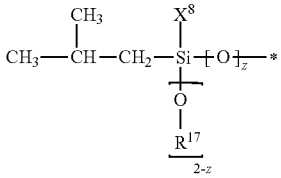

(B-8)

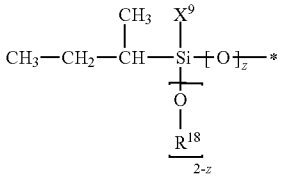

(B-9)

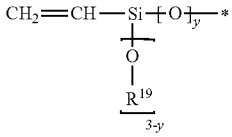

(B-10)

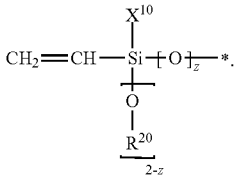

10. An electrophotographic apparatus comprising: an electrophotographic photosensitive member having an electro-conductive support, an undercoat layer, a charge generation layer and a charge transport layer in this order; and at least one unit selected from the group consisting of a charging unit, an exposure unit, a developing unit and a transfer unit, wherein an atomic concentration ratio R of an oxygen atom to an aluminum atom on a surface of the electro-conductive support, as measured by energy dispersive X-ray spectroscopy, satisfies the following Expression (1):

$$1.6 \leq R \quad (1)$$

and the undercoat layer comprises a titanium oxide particle, and the titanium oxide particle has at least one organic functional group represented by the following Formulae (B-1) to (B-10) on the surface, wherein $R^{11}$ to $R^{20}$ represent a methyl group, an ethyl group or an acetyl group; $X^6$ to $X^{10}$ represent a hydrogen atom or a methyl group; x is an integer of 1 to 7; y is an integer of 1 to 3; z is an integer of 1 to 2; and the organic functional group is bonded to the surface of the titanium oxide particle at *
(B-1)
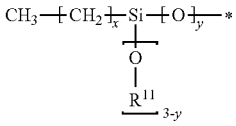
(B-2)
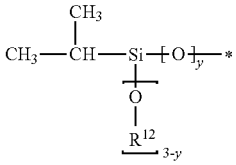
(B-3)
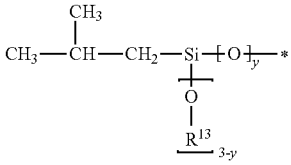
(B-4)
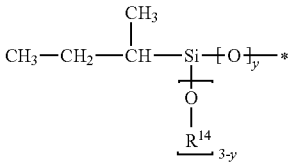
(B-5)
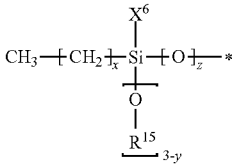
-continued
(B-6)
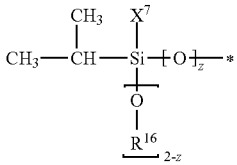
(B-7)
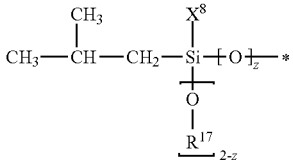
(B-8)
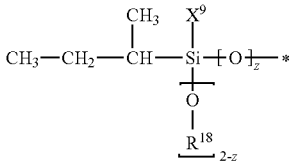
(B-9)
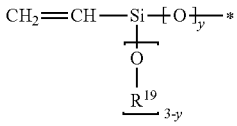
(B-10)
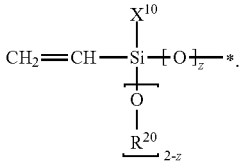
* * * * *